US006483463B2

(12) United States Patent
Kadambi et al.

(10) Patent No.: US 6,483,463 B2
(45) Date of Patent: Nov. 19, 2002

(54) DIVERSITY ANTENNA SYSTEM INCLUDING TWO PLANAR INVERTED F ANTENNAS

(75) Inventors: Govind R. Kadambi, Lincoln, NE (US); Kenneth D. Simmons, Lincoln, NE (US); Sripathi Yarasi, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 09/818,410

(22) Filed: Mar. 27, 2001

(65) Prior Publication Data

US 2002/0140612 A1 Oct. 3, 2002

(51) Int. Cl.[7] ..... H01Q 1/24

(52) U.S. Cl. ..... 343/700 MS; 343/846; 343/702

(58) Field of Search ..... 343/700 MS, 702, 343/725, 846; 455/90, 273

(56) References Cited

U.S. PATENT DOCUMENTS

| | | | | |
|---|---|---|---|---|
| 5,550,554 A | * | 8/1996 | Erkocevic | 343/828 |
| 5,764,190 A | | 6/1998 | Murch et al. | 343/702 |
| 5,926,139 A | | 7/1999 | Korisch | 343/702 |
| 5,966,097 A | | 10/1999 | Fukasawa et al. | 343/700 MS |
| 5,977,916 A | * | 11/1999 | Vannatta et al. | 343/702 |
| 6,034,636 A | | 3/2000 | Saitoh | 343/700 MS |
| 6,295,030 B1 | * | 9/2001 | Kozakai et al. | 343/700 MS |

OTHER PUBLICATIONS

"Dual–Frequency Planar Inverted F–Antenna", by Zi Dong Liu, et al., published Oct. 1997 in IEEE Transactions on Antennas and Propagation, vol. 45, No. 10.

"Optimising the Radiation Pattern of Dual–Frequency Inverted–F Planar Antennas", by Pawel Kabacik, et al., publication and date unknown, pp. 655–658.

"The C–Patch: A Small Microstrip Element", by G. Kossiavas, et al., published Dec. 15, 1988, publication unknown.

"Double C–Patch Antennas Having Different Aperture Shapes", by Mohamed Sanad, publication and date unknown, pp. 2116–2119.

* cited by examiner

*Primary Examiner*—Don Wong
*Assistant Examiner*—James Clinger
(74) *Attorney, Agent, or Firm*—Thomte, Mazour & Niebergall; Dennis L. Thomte

(57) ABSTRACT

A diversity antenna comprising two planar inverted F antennas (PIFAs) characterized by: two radiating elements with or without the physical separation between them; the spatially separable radiating elements of the two PIFAs with side-by-side or orthogonal placement with respect to each other are combined to form an equivalent single element consisting of the composite assembly of two radiators; a small ground plane of rectangular or L-shape with or without bending at its opposite ends is common to both the radiating elements; the radiating elements are placed above the unbent common ground plane; the radiating elements are placed above the vertical sections of the bent common ground plane; the shorted ends of the spatially separated radiating elements are placed back to back on the said common ground plane; a common shorting post placed along the common boundary line resulted by the merging of the two radiators with a prior side by side mutual placement; a common shorting post placed within the common boundary surface resulted by the merging of the two radiators with a prior mutual orthogonal orientation.

10 Claims, 17 Drawing Sheets

20
22c
22b
23b
13
12

21a
19
12
22c
22b
13
16c
16b
11
14
15a 16c
17b
11
13

21a
12
22a
24
12a
19
26
22b
21b
22c
13b
13

15b
16c
13a
25
16b
14
15a
11
16a
17a
18
11a

DIVERSITY ANTENNA SYSTEM INCLUDING TWO PLANAR INVERTED F ANTENNAS

BACKGROUND OF THE INVENTION

1. Field of the Invention

This invention relates to a diversity antenna system which includes two planar inverted F antennas which have a small common ground plane. Four embodiments of the invention are disclosed herein.

2. Description of the Related Art

In its simplest form, the diversity technique, as it applies to antennas for RF data and wireless communication devices, provides a means of achieving reliable and enhanced system performance through the use of an additional antenna. A diversity antenna system utilizes two antennas which sample the RF signal to determine the strongest signal to enable the communication device to utilize the strongest RF signal. To meet the requirement of sustained and fast rate of data transfer, specific emphasis has been recently placed on diversity antennas in RF data communication. Despite the enhanced reliability and the improved performance of an antenna system with the diversity scheme, its adoption to a compact wireless system is not widespread. Theoretically, the spatial diversity technique requires a physical separation of one wavelength between the two antennas. In many practical applications, it may not be feasible to provide the required separation between the two antennas of a spatial diversity scheme. The requirement of a wide separation between the two antennas of a diversity scheme also requires a longer feed cable to the individual antennas from a common RF source point. The resulting longer feed cable leads to the problem of ensuring effective shielding of the cable, the consequent RF power loss in the cable and the undesirable interference effect on system performance particularly at a higher frequency band. The above-mentioned shortcomings apply to diversity schemes consisting of conventional external antennas which have been in existence for a long time as well as with the recently evolving internal antenna. In view of the above constraints associated with the conventional diversity scheme, emphasis is being shifted to arrive at a compactness of the overall spatial diversity scheme which meets acceptable performance standards.

Of late there has been an increasing emphasis on internal antennas instead of a conventional external wire antenna. The concept of internal antenna stems from the avoidance of a protruding external radiating element by the integration of the antenna into the device itself. Internal antennas have several advantageous features such as being less prone for external damage, a reduction in overall size of the handset with optimization, and easy portability. The printed circuit board of the communication device serves as the ground plane of the internal antenna. Among the various choices for internal antennas, the PIFA appears to have great promise. The PIFA is characterized by many distinguishing properties such as relative lightweight, ease of adaptation and integration into the device chassis, moderate range of bandwidth, Omni directional radiation patterns in orthogonal principal planes for vertical polarization, versatility for optimization, and multiple potential approaches for size reduction. Its sensitivity to both vertical and horizontal polarization is of immense practical importance in mobile cellular/RF data communication applications because of the absence of the fixed antenna orientation as well as the multi-path propagation conditions. All these features render the PIFA to be a good choice as an internal antenna for mobile cellular/RF data communication applications.

The PIFA also finds useful applications in diversity schemes. Despite all of the desirable properties of a PIFA, the PIFA has the limitation of a rather large physical size for practical application. A conventional PIFA should have the semi-perimeter (sum of the length and the width) of its radiating element equal to one-quarter of a wavelength at the desired frequency. With the rapidly advancing size miniaturization of the radio communication devices, the space requirement of a conventional PIFA is a severe limitation for its practical utility. Further, the internal antenna technology is relatively new and is in an evolving stage of development. The combination of inherent shortcomings associated with the size of the PIFA and the requirement of even larger space or volume for multiple PIFAs seems to be the primary reason for the non-feasibility of the use of PIFA for diversity schemes of modern wireless communication systems.

To assist in the understanding of a conventional PIFA, a conventional single band PIFA assembly is illustrated in FIGS. 9A and 9B. The PIFA 110 shown in FIG. 9A and FIG. 9B consists of a radiating element 101, a ground plane 102, a connector feed pin 104*a*, and a conductive post or pin 107. A power feed hole 103 is located corresponding to the radiating element 101. The connector feed pin 104*a* serves as a feed path for radio frequency (RF) power to the radiating element 101. The connector feed pin 104*a* is inserted through the feed hole 103 from the bottom surface of the ground plane 102. The connector feed pin 104*a* is electrically insulated from the ground plane 102 where the pin passes through the hole in the ground plane 102. The connector feed pin 104*a* is electrically connected to the radiating element 101 at 105*a* with solder and the body of the feed connector 104*b* is electrically connected to the ground plane at 105*b* with solder. The connector feed pin 104*a* is electrically insulated from the body of the feed connector 104*b*. A through hole 106 is located corresponding to the radiating element 101, with the conductive post or pin 107 being inserted through the hole 106. The conductive post 107 serves as a short circuit between the radiating element 101 and the ground plane 102, The conductive post 107 is electrically connected to the radiating element 101 at 108*a* with solder. The conductive post 107 is also electrically connected to the ground plane 102 at 108*b* with solder. The resonant frequency of the PIFA 110 is determined by the length (L) and width (W) of the radiating element 101 and is slightly affected by the locations of the feed pin 104*a* and the shorting pin 107. The impedance match of the PIFA 110 is achieved by adjusting the diameter of the connector feed pin 104*a*, by adjusting the diameter of the conductive shorting post 107, and by adjusting the separation distance between the connector feed pin 104*a* and the conductive shorting post 107.

SUMMARY OF THE INVENTION

In this invention, several new embodiments of compact diversity PIFAs having a small and common ground plane are disclosed. This invention demonstrates that it is possible to retain the performance of individual antennas of a spatial diversity antenna scheme even when the separation between the antennas is only a fraction of a wavelength. In the first embodiment of this invention, two PIFAs are placed back to back on a small rectangular ground plane. The two PIFAs are placed such that the shorted ends of the PIFAs face each other. Such an arrangement ensures better isolation between the two PIFAs despite being placed in close proximity to one another. In the second embodiment of this invention, the ground plane is bent at its opposite ends to form vertical sections. The two PIFAs are placed (outward) on the vertical sections at the opposite ends of the ground plane. Such an arrangement of PIFAs allows the placement of some system components between the two vertical sections of the bent ground plane. The distortion of the radiation patterns of the PIFAs is also minimized despite the presence of some components between the two PIFAs. This is mainly due to the blockage effect offered by the vertical sections of the ground plane. With a significantly different design configuration, in the third embodiment of this invention, there is no physical separation between the two PIFAs placed on a common rectangular ground plane. Only a single shorting pin or post partitions the two diversity PIFAs resulting in an extremely simple and compact diversity PIFA. The virtual electrical partitioning between the two radiating elements is realized through the common shorting post. The virtual electrical partitioning between the two radiating elements in lieu of the proposed choice of placement of the shorting post overcomes the need for physical separation between the two radiating elements to serve as separate antennas of a diversity scheme. In the fourth embodiment, which is a modification of th e third embodiment, the two PIFAs, which are not physically separated, are placed on a common L-shaped ground plane. The partitioning of the two antennas is again realized through a common shorting post. Unlike the third embodiment, the two PIFAs of the fourth embodiment are oriented orthogonal to each other. The basic concepts proposed in all the embodiments of this invention have been proved through the design of diversity PIFAs for ISM Band applications. In all of the above-described embodiments, good VSWR performance is achieved. The individual PIFAs of the embodiments show satisfactory gain performance. The invention disclosed herein can be extended to other frequency bands of interest.

One of the principal objects of the invention is to circumvent the requirement of wide separation between the two internal PIFAs of a spatial diversity scheme.

A further object of the invention is to provide an efficient design of a diversity antenna utilizing only a small ground plane that is common for both the antennas.

Still another object of the invention is to provide a compact diversity PIFA characterized with the salient feature of the absence of physical partitioning between the two antennas.

Yet another object of the invention is to utilize the common ground plane of non-rectangular shapes in diversity PIFAs.

Another object of the invention is to design individual PIFAs of a diversity antenna which are compact in size.

Still another object of the invention is to provide diversity PIFAs having the desirable features of configuration simplicity, compact size, cost effective to manufacture and ease of fabrication.

These and other objects will be apparent to those skilled in the art.

BRIEF DESCRIPTION OF THE DRAWINGS

FIG. 1 is an illustration of the design configuration of compact diversity PIFAs according to the first embodiment of the present invention;

FIG. 2 is a frequency response chart that depicts the characteristics of the VSWR of the embodiment of FIG. 1;

FIG. 3 is an illustration of the design configuration of compact diversity PIFAs according to the second embodiment of the present invention;

FIG. 4 is a frequency response chart that depicts the characteristics of the VSWR of the embodiment of FIG. 3;

FIG. 5 is an illustration of the design configuration of a compact diversity PIFA according to the third embodiment of the present invention;

FIG. 6 is a frequency response chart that depicts the characteristics of the VSWR of the embodiment FIG. 5;

FIG. 7 is an illustration of the design configuration of compact diversity PIFAs according to the fourth embodiment of the present invention;

FIG. 8 is a frequency response chart that depicts the characteristics of the VSWR of the embodiment of FIG. 7;

DESCRIPTION OF THE PREFERRED EMBODIMENTS

Figure 1A:
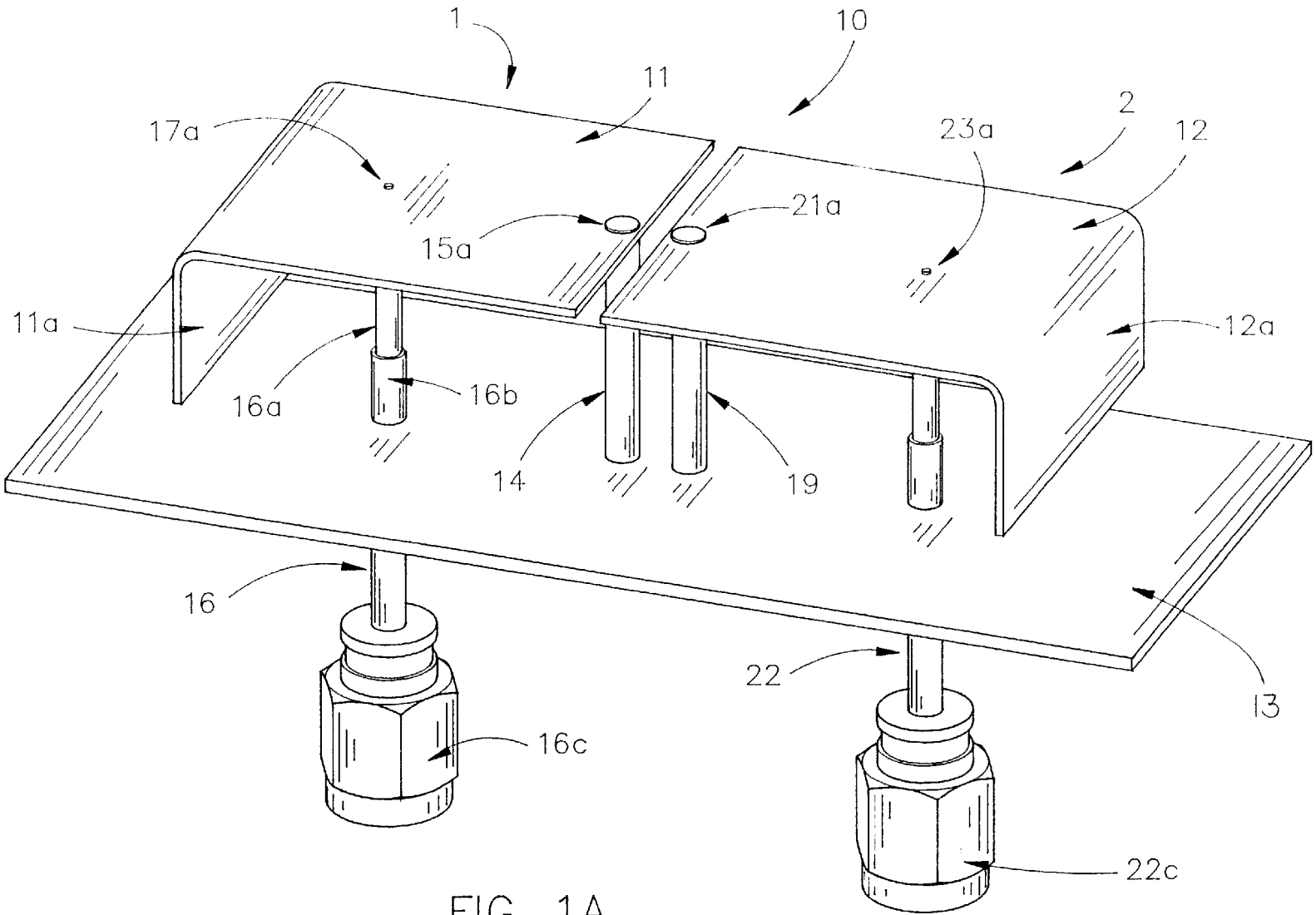
FIG. 1A is an isometric view of the compact diversity using PIFAs according to the first embodiment of the present invention.
Figure 1B:
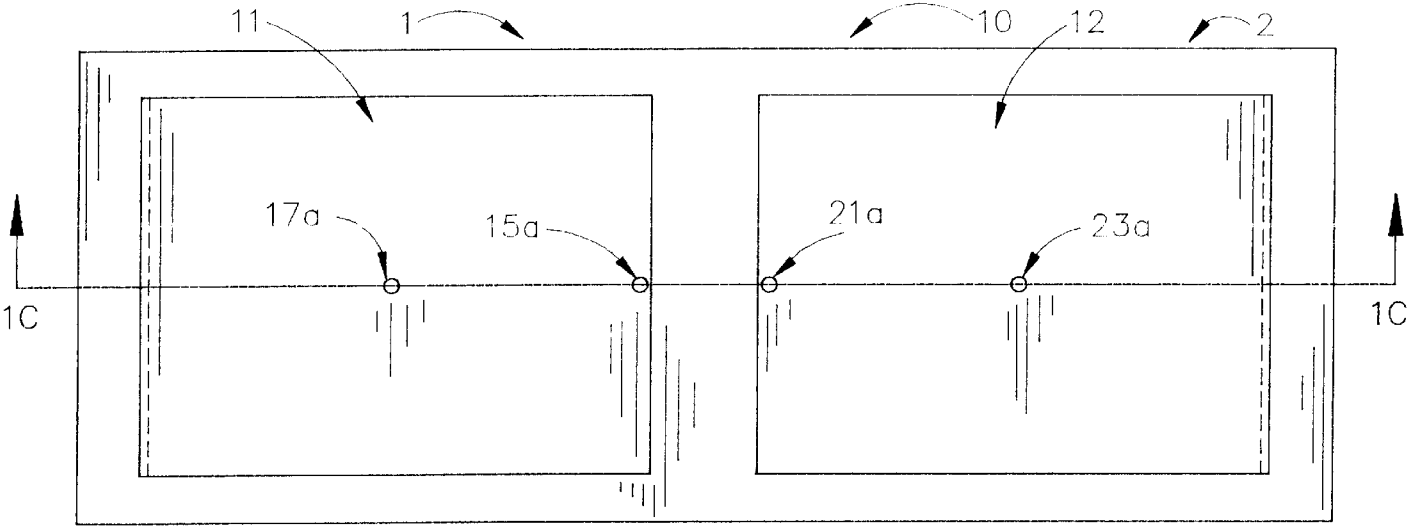
FIG. 1B is a top view of the design configuration of the compact diversity PIFAs according to the first embodiment of the present invention.
Figure 1C:
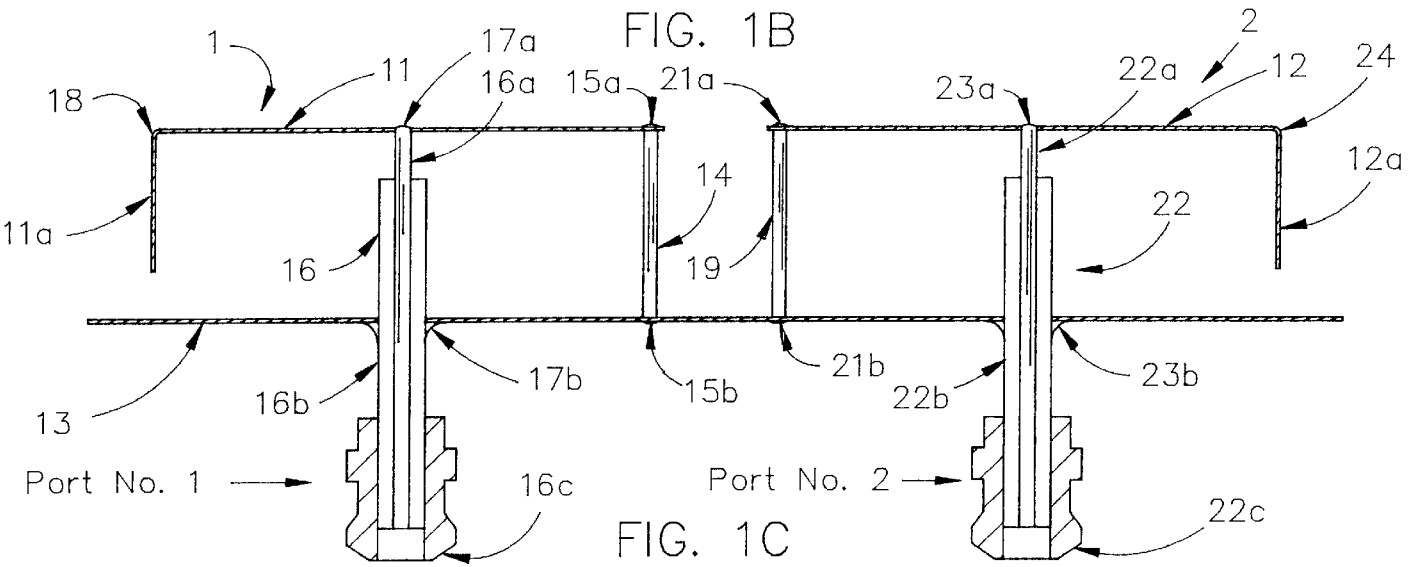
FIG. 1C is a sectional view of the design configuration of the compact PIFAs taken along the line C–C' of FIG. 1B.

In the accompanying text describing the compact diversity PIFAs using a small and common ground plane covered under the first embodiment of this invention, refer to the FIGS. 1A–1C for illustrations. The compact diversity PIFA antenna 10 includes two radiating elements 11 and 12 that are placed above the common and small ground plane 13. The PIFA including radiating element 11 is designated as antenna 1. A conducting post 14 connects the ground plane 13 and the radiating element 11 and serves as a short circuiting element. The conducting post 14 is connected to the radiating element 11 at 15*a* by solder and the conducting post 14 is also connected to the ground plane 13 at 15*b* by solder. A coaxial cable 16 serves as an electrical path for radio frequency (RF) power to the radiating element 11 is extended through a hole in the ground plane 13, as seen in FIG. 1C. The inner conductor 16*a* of coaxial cable 16 forms a feed conductor and the top end of the feed conductor 16*a* is electrically connected to the radiating element 11 at 17*a*. The outer conductor 16*b* of the feed cable is connected to the ground plane 13 at 17*b*. The feed conductor 16*a* is insulated from the outer conductor 16*b* by means of an insulator of the RF cable. The bottom end of the feed conductor 16*a* of cable 16 is terminated with a SMA connector 16*c*. The connector 16*c* forms the Port #1 of the diversity PIFA 10. Radiating element 11 is bent 90° at 18 to form a vertical plane 11*a*. Vertical plane 11*a* forms the capacitive loading plate of the radiating element 11. The capacitive loading element 11*a* is designed for lowering the resonant frequency of the radiating element 11 without increasing the size of the PIFA. The PIFA with the radiating element 11 explained above and illustrated in FIGS. 1A–1C functions as a single band PIFA. The dimensions of the radiating element 11, the length of the vertical plane 11*a,* the location of the shorting post 14, the diameter of the shorting post 14, and the relative position of the radiating element 11 on the common ground plane 13 are the prime parameters that control the resonant frequency of the radiating element 11 of the PIFA. The bandwidth of the single band PIFA with radiating element 11 is determined by: the location of the feed conductor 16*a,* the location of the shorting post 14, the diameter of the shorting post 14 and the linear dimensions of the radiating element 11 including the height (distance between the radiating element and the ground plane) of the PIFA. The distance of separation between the radiating elements 11 and 12 is also an additional parameter of importance (for both the resonant frequency and bandwidth of the radiating element 11) since the close proximity of the two radiating elements 11 and 12 influence each other. The resonant frequency of the PIFA with the vertical capacitive loading section is lower than the resonant frequency of the PIFA with the radiating element 11 alone.

The PIFA with the radiating element 12 is designated as antenna 2 of the diversity antenna 10. A conducting post 19 connects the common ground plane 13 and the radiating element 12 and serves as a short circuiting element. Conducting post 19 is electrically connected to the radiating element 12 at 21*a* by solder and the conducting post 19 is electrically connected to the ground plane 13 at 21*b*. A coaxial cable 22 that serves as an electrical path for radio frequency (RF) power to the radiating element 12 is drawn through a hole in the ground plane 13, as seen in FIG. 1C. The inner conductor 22*a* of coaxial cable 22 forms a feed conductor for the radiating element 12 and the top end of the feed conductor 22*a* is electrically connected to the radiating element 12 at 23*a*. The outer conductor 22*b* of the feed cable is electrically connected to the ground plane 13 at 23*b*. The feed conductor 22*a* is insulated from the outer conductor 22*b* through an insulator of the cable 22. The bottom end of the feed conductor 22*a* of the RF cable 22 is terminated with a SMA connector 22*c*. The connector 22*c* forms the Port #2 of the PIFA antenna 10.

Figure 2A:
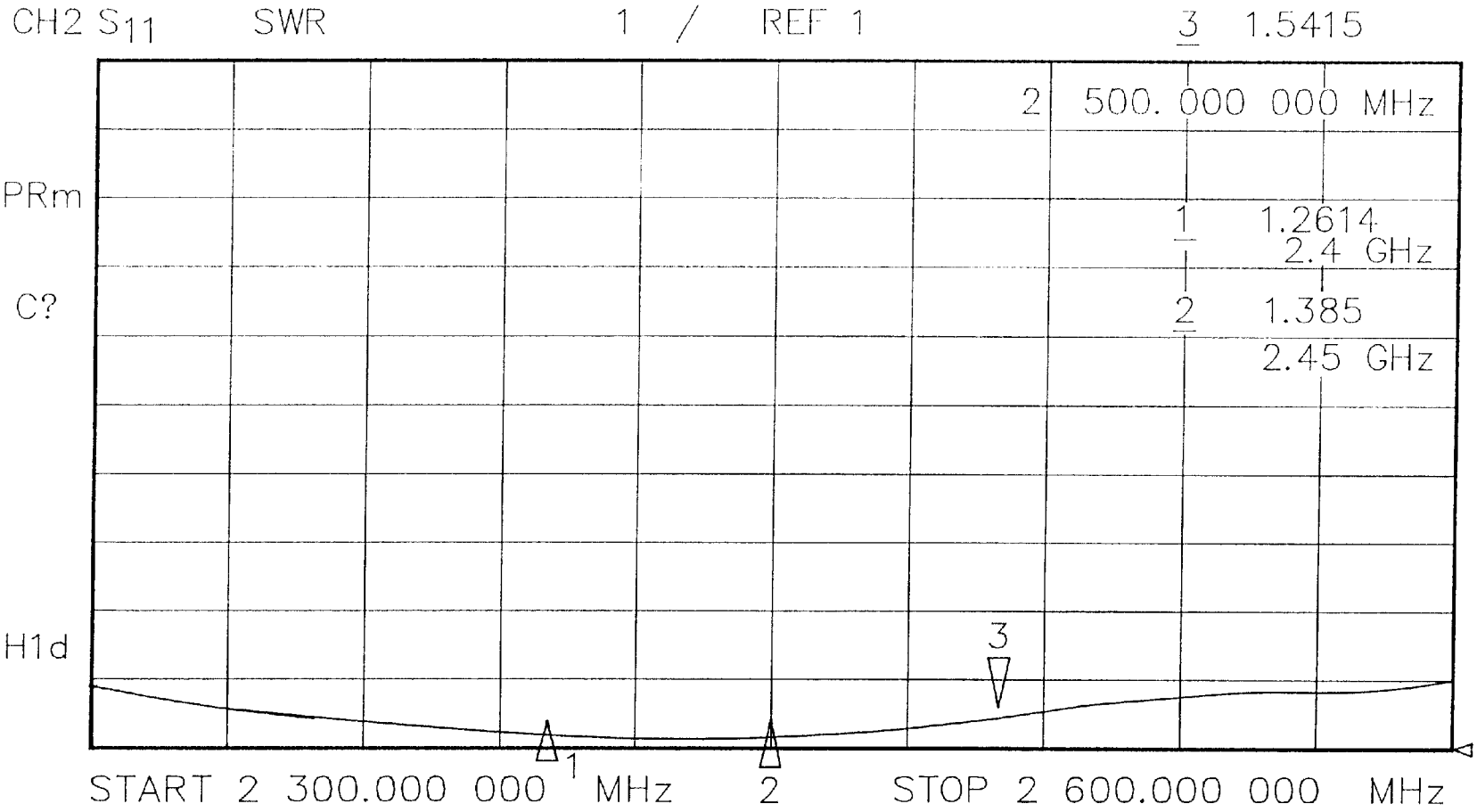
FIG. 2A is a frequency response chart that depicts the characteristics of the VSWR of the first PIFA (Port #1) of the embodiment of FIG. 1.
Figure 2B:
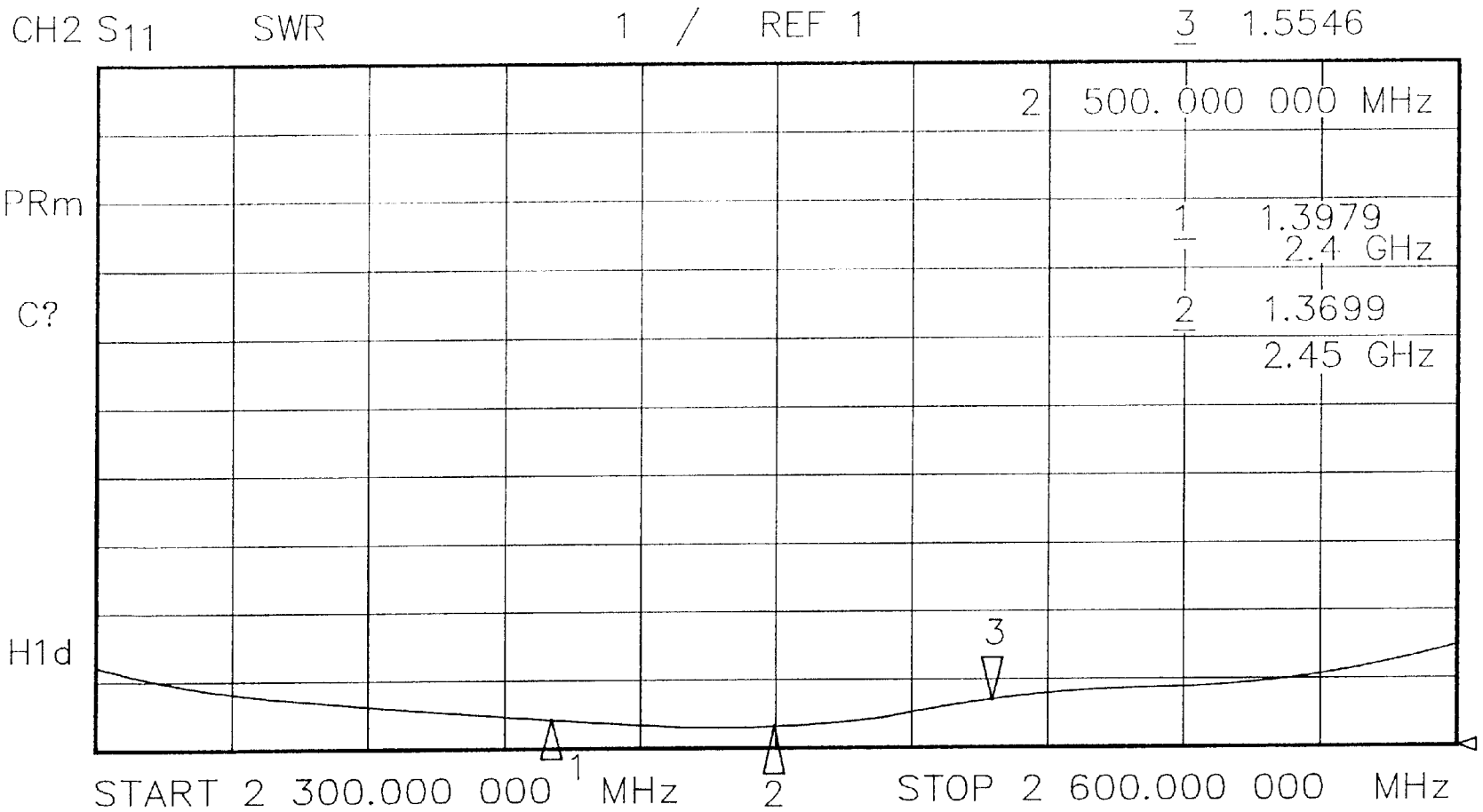
FIG. 2B is a frequency response chart that depicts the characteristics of the VSWR of the second PIFA (Port #2) of the embodiment of FIG. 1.

The radiating element 12 is bent 90° at 24 to form a vertical plane 12*a*. The vertical plane 12*a* forms the capacitive loading plate of the radiating element 12. The capacitive loading element 12*a* is designed for lowering the resonant frequency of the radiating element 12 without increasing the size of the PIFA. The PIFA configuration with radiating element 12 described above and shown in FIGS. 1A–1C functions as a single band PIFA. The prime parameters that control the resonant frequency of the radiating element 12 of the PIFA are: the dimensions of the radiating element 12, the length of the vertical plane 12*a,* the location of the shorting post 19, the diameter of the shorting post 19, and the relative position of the radiating element 12 on the common ground plane 13. The bandwidth of the single band PIFA with the radiating element 12 is determined by: the location of the feed conductor 22*a* on the radiating element 12, the location of the shorting post 19, the diameter of the shorting post 19 and the linear dimensions of the radiating element 12 including the height of the PIFA. The distance of separation between the radiating elements 12 and 11 is also an additional parameter of importance (for both the resonant frequency and bandwidth of the radiating element 12) since the close proximity of the two radiating elements 11 and 12 influence each other. To achieve the overall size reduction of the diversity antenna, the distance between the radiating elements 11 and 12 has been decreased considerably. To overcome the shortcomings such as enhanced mutual coupling associated with the close placements of the radiating elements 11 and 12, the shorted ends (edges) of the two radiating elements 11 and 12 are designed to face other. Based on the first embodiment of this invention, a compact schematic design for diversity PIFAs with a common and small ground plane has been developed for ISM band (2400–2500 MHz). The two separate PIFAs constituting the two antennas with Port #1 and Port #2 of the diversity antenna 10 according to the first embodiment of this invention have been designed and fabricated. The results of the tests conducted on the compact diversity antenna 10 comprising the PIFAs 1 and 2 illustrated in FIGS. 1A–1C are shown in FIG. 2. The VSWR Characteristics of the first PIFA (with the radiating element 11 and RF input designated as Port #1) are shown in FIG. 2A. Analogous to the first PIFA with input as Port #1, the VSWR characteristics of the second PIFA (with the radiating element 12 and RF input designated as Port #2) are shown in FIG. 2B. As can be seen from the FIGS. 2A and 2B, good impedance match has been achieved for both the PIFAs of the diversity antenna 10 outlined in the first embodiment of this invention. The size of the common ground plane 13 is 18 mm (wide) and 42 mm (length). The projected semi-perimeter of the radiating elements 11 and 12 is 28 mm as compared to the semi-perimeter of 30.61 mm of a conventional PIFA radiating element without the capacitive loading feature. From the above description, it can be seen that a compact layout for a diversity scheme comprised of two PIFAs with separate input ports has been realized.

Figure 3A:
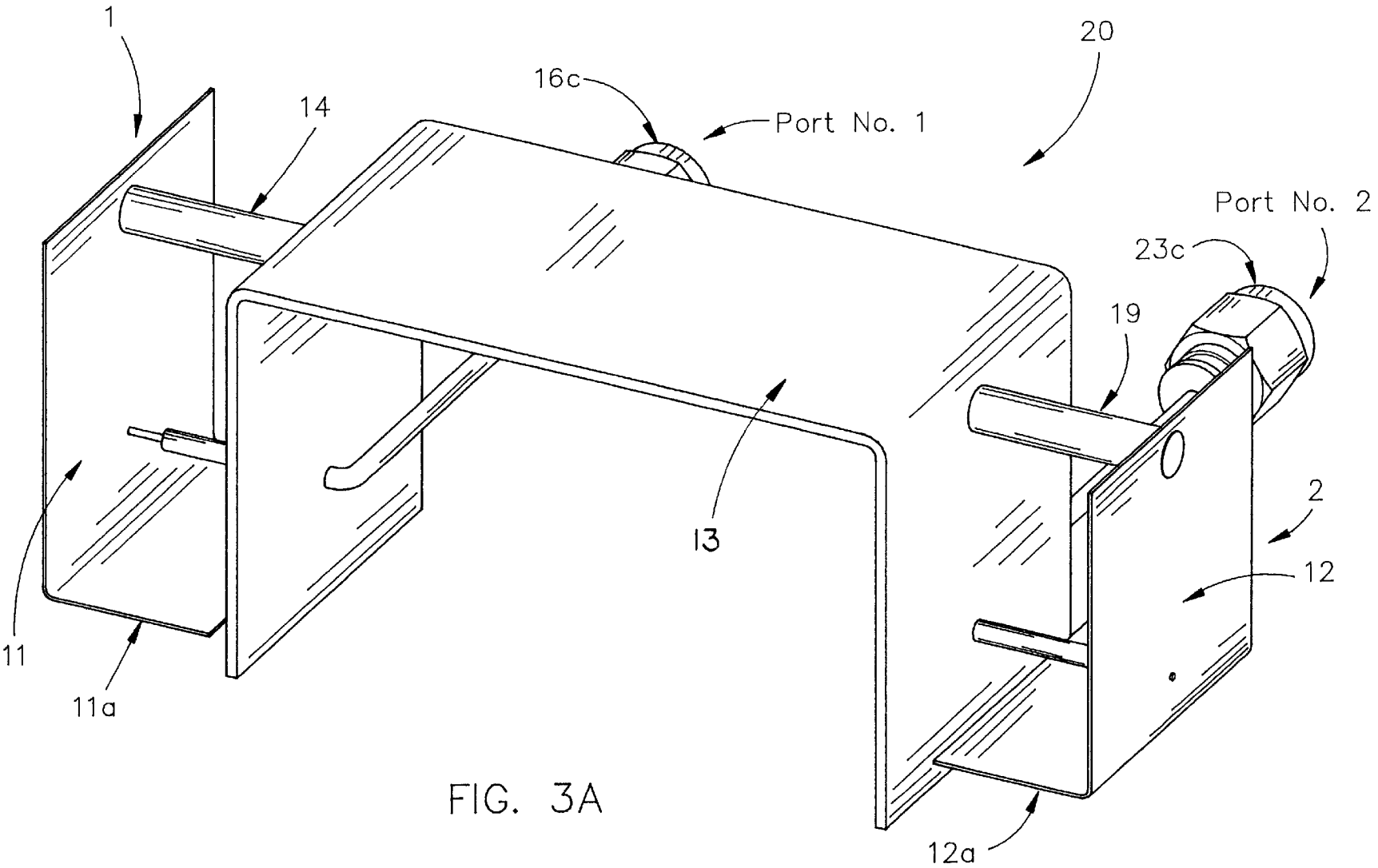
FIG. 3A is an isometric view of the compact diversity PIFAs according to the second embodiment of the present invention.
Figures 3B, 3C, 3D, 3E:
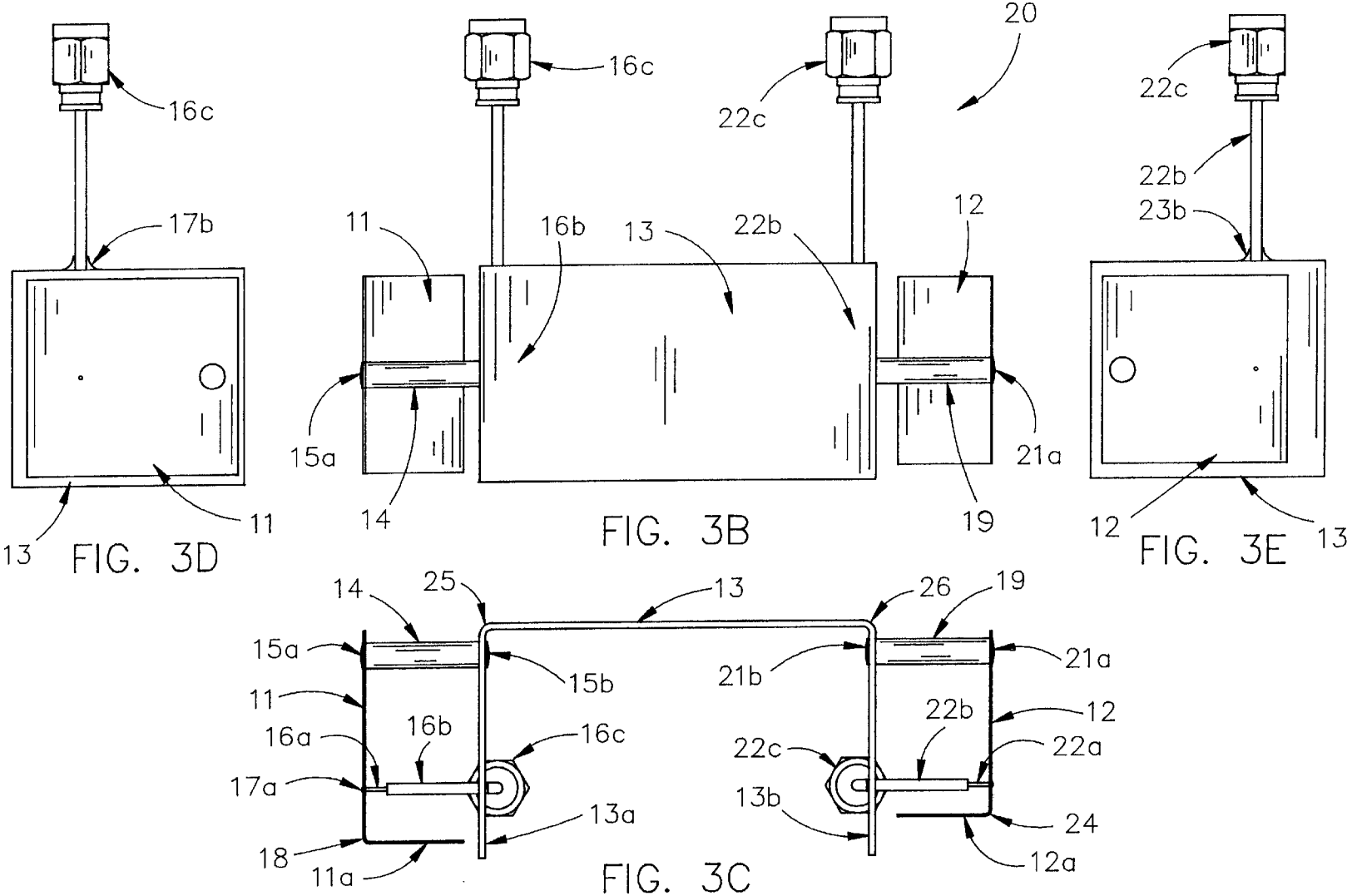
FIG. 3B is a top view as well as the end view of the second embodiment of the present invention.
FIG. 3C is a side view of the second embodiment of FIG. 3B.
FIG. 3D is an end view of the second embodiment of FIG. 3B as seen from the left of FIG. 3B.
FIG. 3E is an end view of the second embodiment of FIG. 3B as seen from the right of FIG. 3B.

In the accompanying text describing the diversity antenna 20 of PIFAs using a common and compact ground plane covered under the second embodiment of this invention, refer to the FIGS. 3A–3C for illustrations. In the second embodiment of this invention, the compact diversity antenna 20 consists of a ground plane bent at the opposite ends which are situated along the direction of the length of the ground plane. As shown in FIGS. 3A–3C, the common ground plane 13 is bent 100° down at 25 forming a vertical section 13*a* of the ground plane. Similarly the common ground plane 13 is also bent 100° down at 26 forming another vertical section 13*b* of the ground plane. In the diversity PIFA 20, the first PIFA with the radiating element 11 is placed outwardly with respect to the vertical section 13*a* of the ground plane 13. The radiating element 11 and the vertical section 13*a* of the ground plane 13 are separated by a predesired distance. Further in the diversity PIFA 20, the second PIFA with the radiating element 12 is also placed outwardly with respect to the vertical section 13*b* of the ground plane 13. Similar to the first PIFA, there exists a pre-desired distance of separation between the radiating element 12 and the vertical section 13*b* of the ground plane. All the other elements of the compact diversity antenna 20 consisting of the two PIFAs are similar to the diversity antenna 10 which has already been explained under the first embodiment of this invention and the further description of the diversity antenna 20 will therefore be omitted.

The PIFA configuration with a radiating element 11 explained above and referred to in FIGS. 3A–3C functions as a single band PIFA. The dimensions of the radiating element 11, the length of the vertical plane 11*a,* the location of the shorting post 14, the diameter of the shorting post 14, and the relative position of the radiating element 11 on the vertical section 13*a* of the common ground plane 13 are the design parameters that control the resonant frequency of the radiating element 11 of the PIFA. The bandwidth of the first PIFA with the radiating element 11 is determined by: the location of the feed conductor 16*a,* the location of the shorting post 14, the diameter of the shorting post 14 and the linear dimensions of the radiating element 11 including the height of the PIFA.

Similar to the first PIFA (designated as antenna 1 with RF input Port #1) with the radiating element 11 of FIGS. 3A–3C, the second PIFA (designated as antenna 2 with RF input Port #2) with the radiating element 12 also functions as a single band PIFA. The dimensions of the radiating element 12, the length of the vertical plane 12*a,* the location of the shorting post 19, the diameter of the shorting post 19, and the relative position of the radiating element 12 on the vertical section 13*b* of the common ground plane 13 are the important factors that determine the resonant frequency of the radiating element 12 of the PIFA. The bandwidth of the second PIFA with radiating element 12 is determined by: the location of the feed conductor 22*a* on the radiating element 12, the location of the shorting post 19, the diameter of the shorting post 19 and the linear dimensions of the radiating element 12 including the height of the PIFA. The two separate compact PIFAs constituting the two antennas with Port #1 and Port #2 of the diversity antenna 20 according to the second embodiment of this invention have been designed and fabricated.

Figure 4A:
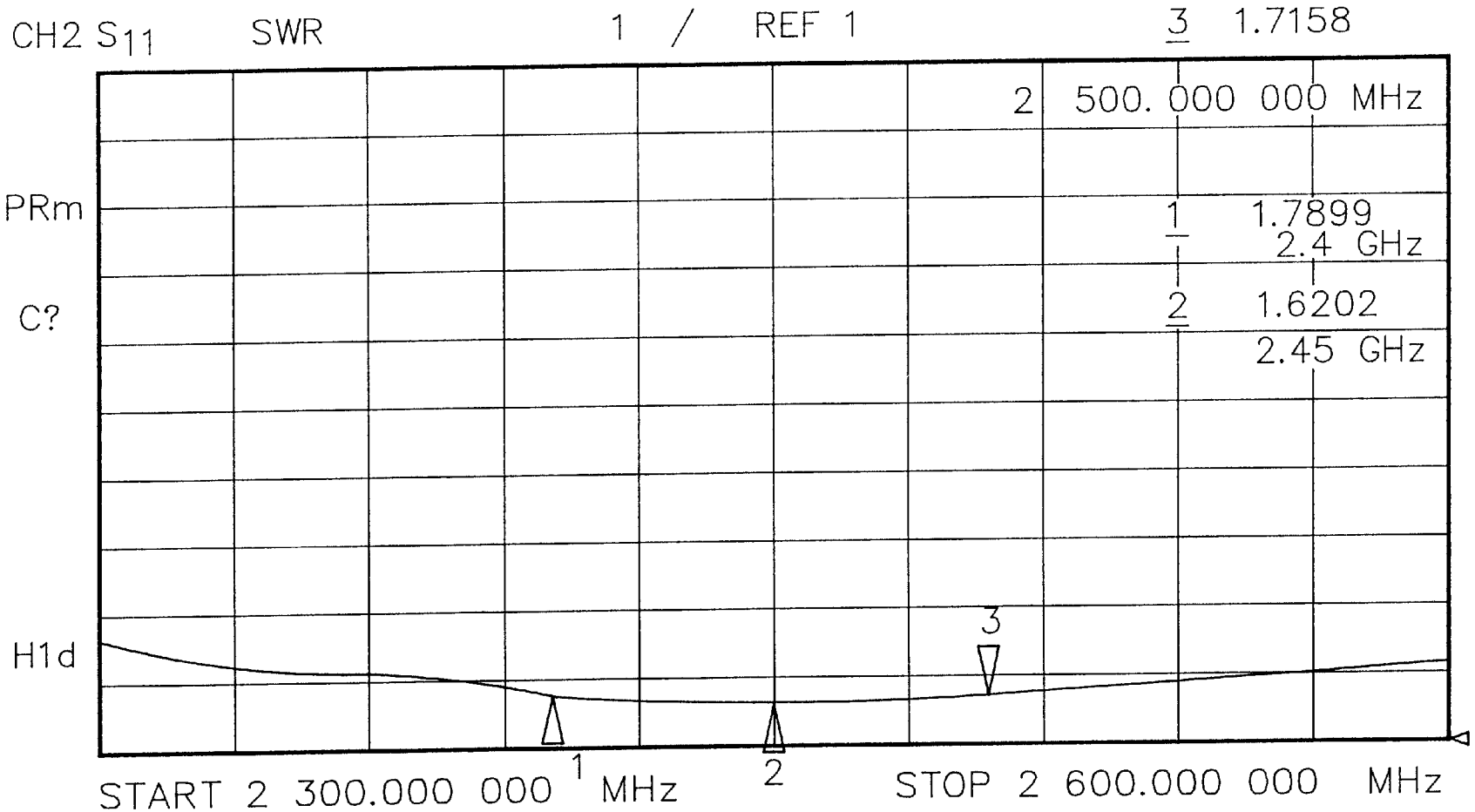
FIG. 4A is a frequency response chart that depicts the characteristics of the VSWR of the first PIFA (Port #1) of the embodiment of FIG. 3.
Figure 4B:
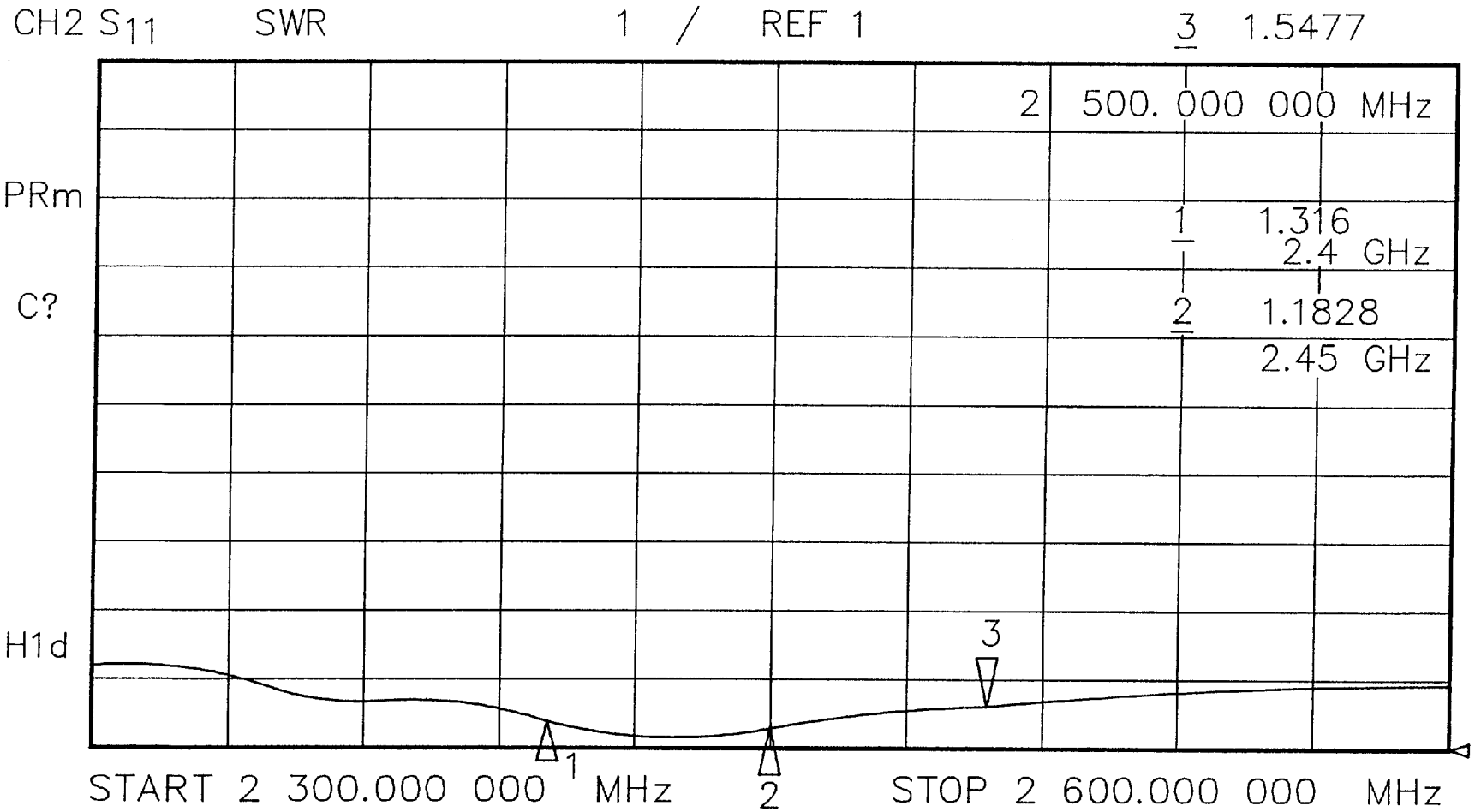
FIG. 4B is a frequency response chart that depicts the characteristics of the VSWR of the second PIFA (Port #2) of the embodiment FIG. 3.

Invoking the design concept enunciated under the second embodiment of this invention, compact diversity PIFAs with a small and common bent ground plane has been developed for ISM band (2400–2500 MHz). The results of the tests conducted on the compact diversity antenna 20 consisting of the two PIFAs shown in FIGS. 3A–3C are illustrated in FIG. 4. The VSWR Characteristics of the first PIFA (with the radiating element 11 and designated RF Input Port #1) are shown in FIG. 4A. Analogous to the first PIFA with input as Port #1, the VSWR characteristics of the second PIFA (with the radiating element 12 and designated RF Input Port #2) are shown in FIG. 4B. As can be seen from the FIGS. 4A and 4B, a good impedance match has been obtained for both the PIFAs of the diversity antenna 20 described in the second embodiment of this invention. The size of the common ground plane is 17 mm (wide) and 30 mm (length). The projected semi perimeter of the radiating elements 11 and 12 is 28 mm as compared to the semi perimeter of 30.61 mm of a conventional PIFA radiating element without the capacitive loading feature. The significant advantage of the compact diversity antenna 20 of the second embodiment of this invention is the possibility for the placement of some of the system components between the vertical sections 13*a* and 13*b* of the ground plane 13. Through the above illustrations and discussions, yet another novel compact layout for a diversity scheme comprising the two compact PIFAs with separate input ports has been realized with a small and common ground plane.

In the diversity antennas 10 and 20 described under the first and second embodiments of this invention, the two PIFAs of a diversity antenna have their radiating elements physically separated from each other. The resulting improvement in isolation between the two RF input ports of the diversity antenna is primarily due to the physical separation between the radiating elements. From the configuration simplicity point of view as well from the fabrication ease consideration, it is always desirable to arrive at a structure of diversity PIFAs devoid of physical partitioning between the radiating elements of the respective PIFAs. The design concept of a single feed dual band PIFA without the physical partitioning of the original single band structure has been addressed by applicants in the paper [G. R. Kadambi et al., "A New Design Method for Single Feed Dual Band PIFA", URSI symposium, Salt Lake City, 2000, pp. 221]. In the above-cited paper, through the selective choice of the shorting post on the PIFA structure, dual band PIFA operation has been realized without the physical partitioning of the structure. The proposed selective placement of the shorting post imparts the virtual electrical partitioning of the PIFA structure there by resulting in the dual resonance characteristics. The above concept of realizing the virtual electrical partitioning of the PIFA structure by a shorting post has been extended to the design of diversity PIFAs as explained in the subsequent embodiments of this invention.

Figure 5A:
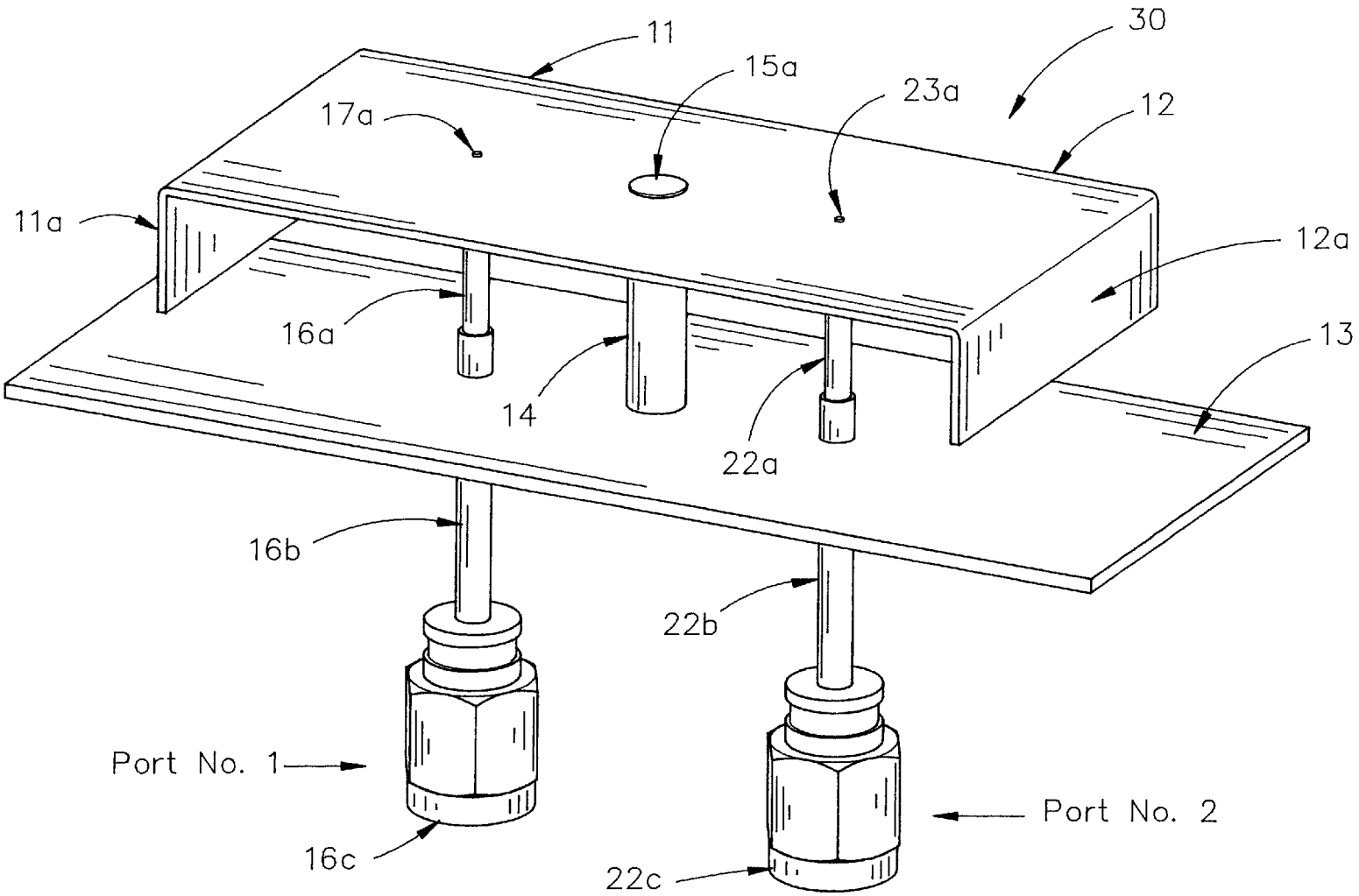
FIG. 5A is an isometric view of the design configuration of compact diversity PIFAs according to the third embodiment of the present invention.
Figure 5B:
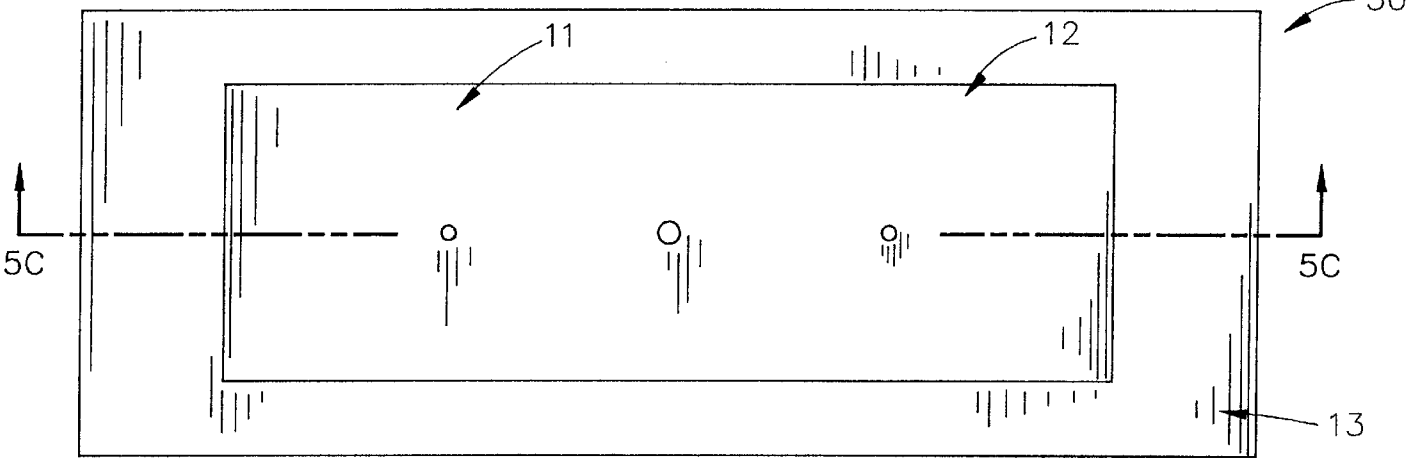
FIG. 5B is a top view of the third embodiment of the present invention.
Figure 5C:
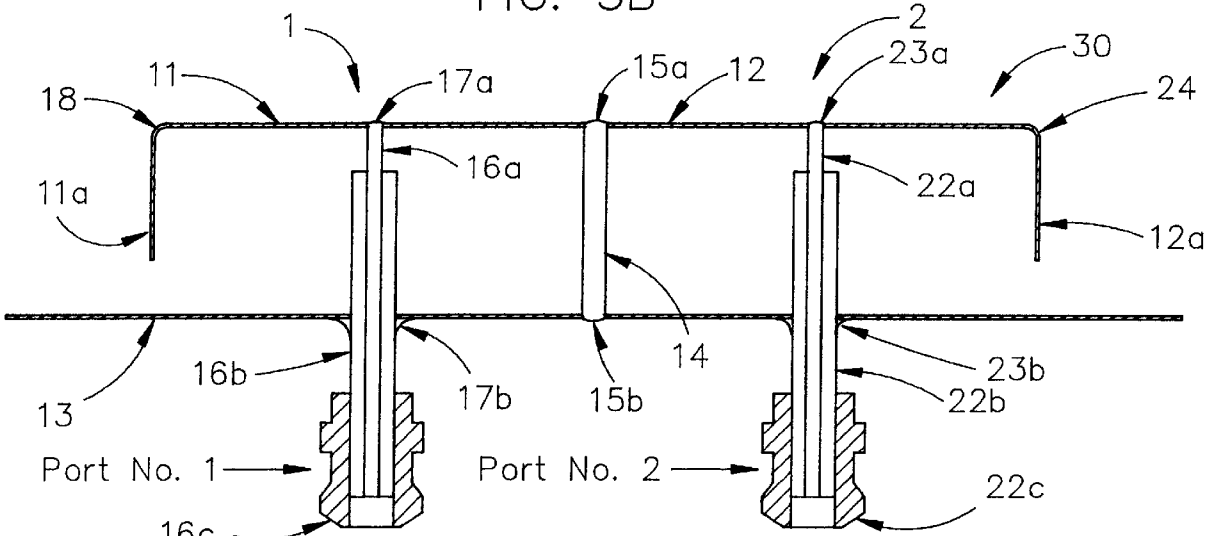
FIG. 5C is a sectional view taken along the line C–C' of FIG. 5B.

In the following text describing the compact diversity layout 30 of PIFAs using a small and common ground plane covered under the third embodiment of this invention, refer to the FIGS. 5A–5C for illustrations. As shown in the FIGS. 5A–5C, the two PIFAs with the radiating elements 11 and 12 exhibit no physical separation between them. Both the radiating elements are placed over a common ground plane 13. The radiating elements 11 and 12 of the PIFAs merge (combine) together along a simple line contour A–A'. The line contour A–A' also forms a common boundary to both the radiating elements 11 and 12. A shorting post 14 placed along A–A' serves as a common short-circuiting element to both the radiators 11 and 12. The virtual electrical partitioning between the two radiating elements 11 and 12 in lieu of the proposed choice of placement of the shorting post 14 overcomes the need for physical separation between the two radiating elements to serve as separate antennas of a diversity scheme. The proposed choice of placement of the shorting post 14 circumvents the need for physical separation between the two radiating elements to serve as separate antennas of a diversity scheme. All the other elements of the diversity antenna 30 illustrated in the FIGS. 5A–5C are similar to the diversity antennas 10, 20 of the first and second embodiments which have already been explained. Therefore further redundant detailed explanation of the diversity antenna 30 will not be provided to avoid the repetition.

The PIFA configuration with a radiating element 11 illustrated in FIGS. 5A–5C functions as a single band PIFA. The resonant frequency of the radiating element 11 of the PIFA depends on: The dimensions of the radiating element 11, the length of the vertical plane 11*a,* the location of the shorting post 14, the diameter of the shorting post 14, and the relative position of the radiating element 11 on the common ground plane 13. The parameters that determine the bandwidth of the single band PIFA with radiating element 11 are: the location of the feed conductor 16*a,* the location of the shorting post 14, the diameter of the shorting post 14 and the linear dimensions of the radiating element 11 including the height of the PIFA. The resonance and the bandwidth characteristics of the first PIFA with the radiating element 11 are also significantly influenced by the second PIFA with the radiating element 12 because of the absence of physical separation between them. This also suggests an increased mutual coupling and reduced isolation between the two ports of a diversity scheme. However, the major advantage of the third embodiment of this invention is that the two PIFAs of the diversity antenna 30 can be fabricated as a single element resulting in the enhanced ease of fabrication. Similar to the PIFA with the radiating element 11 (designated as antenna 1 and RF input Port #1) of FIGS. 5A–5C, the PIFA with the radiating element 12 (designated as antenna 2 and RF input Port #2) also functions as a single band PIFA. The dimensions of the radiating element 12, the length of the vertical plane 12*a,* the location of the shorting post 14, the diameter of the shorting post 14, and the relative position of the radiating element 12 on the common ground plane 13 determine the resonant frequency of the radiating element 12 of the PIFA. The bandwidth of the single band PIFA with radiating element 12 is dependent on: the location of the feed conductor 22*a* on the radiating element 12, the location of the shorting post 14, the diameter of the shorting post 14 and the linear dimensions of the radiating element 12 including the height of the PIFA. To prove the novel design concept explained under the third embodiment of this invention, a compact schematic layout for diversity PIFAs with a common and compact ground plane has been developed for ISM band (2400–2500 MHz). The two separate compact PIFAs constituting the two antennas with Port #1 and Port #2 of the diversity antenna 30 according to the third embodiment of this invention have been designed and fabricated.

Figure 6A:
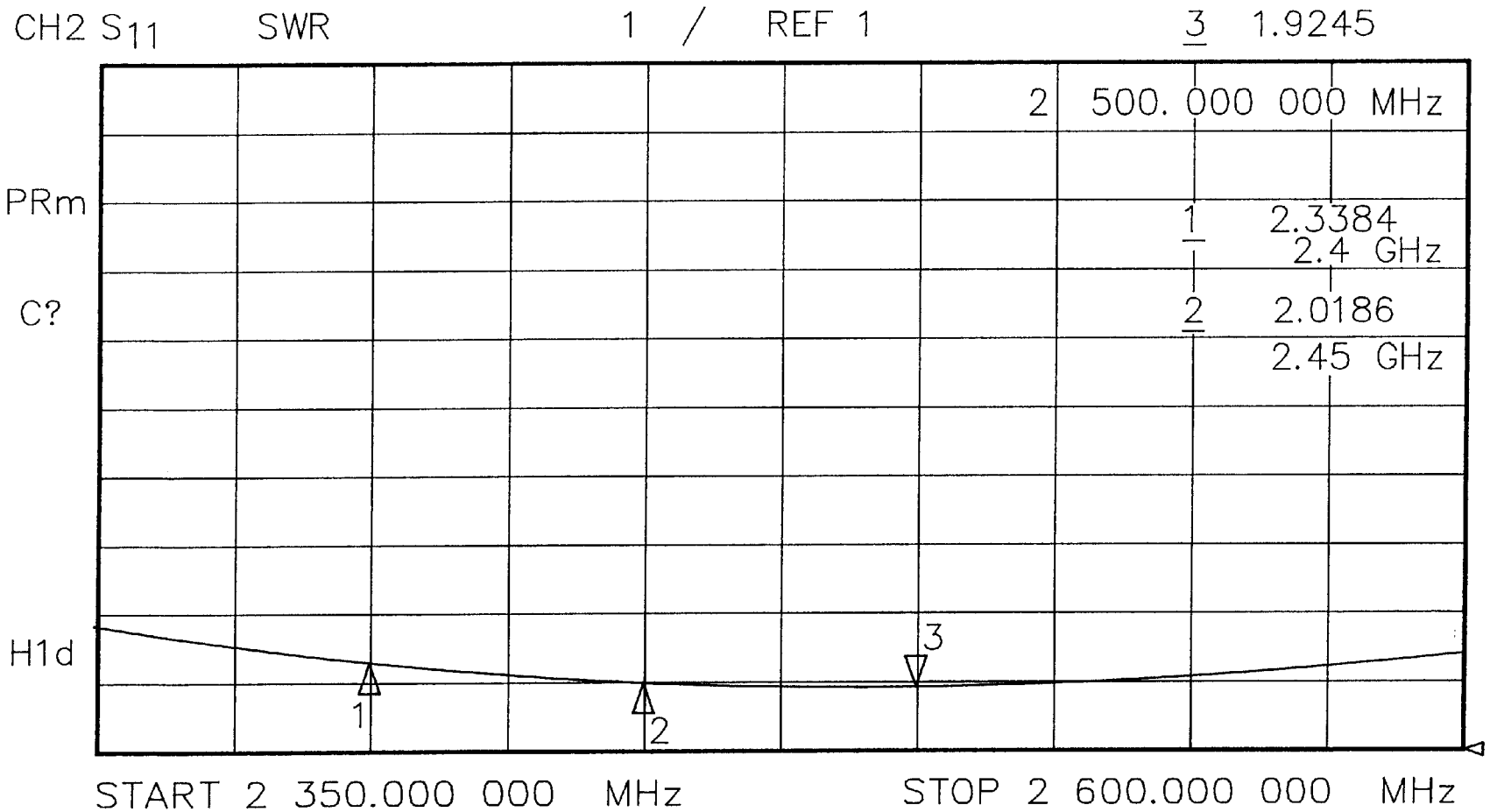
FIG. 6A is a frequency response chart that depicts the characteristics of the VSWR of the first PIFA (Port #1) of the embodiment of FIG. 5.
Figure 6B:
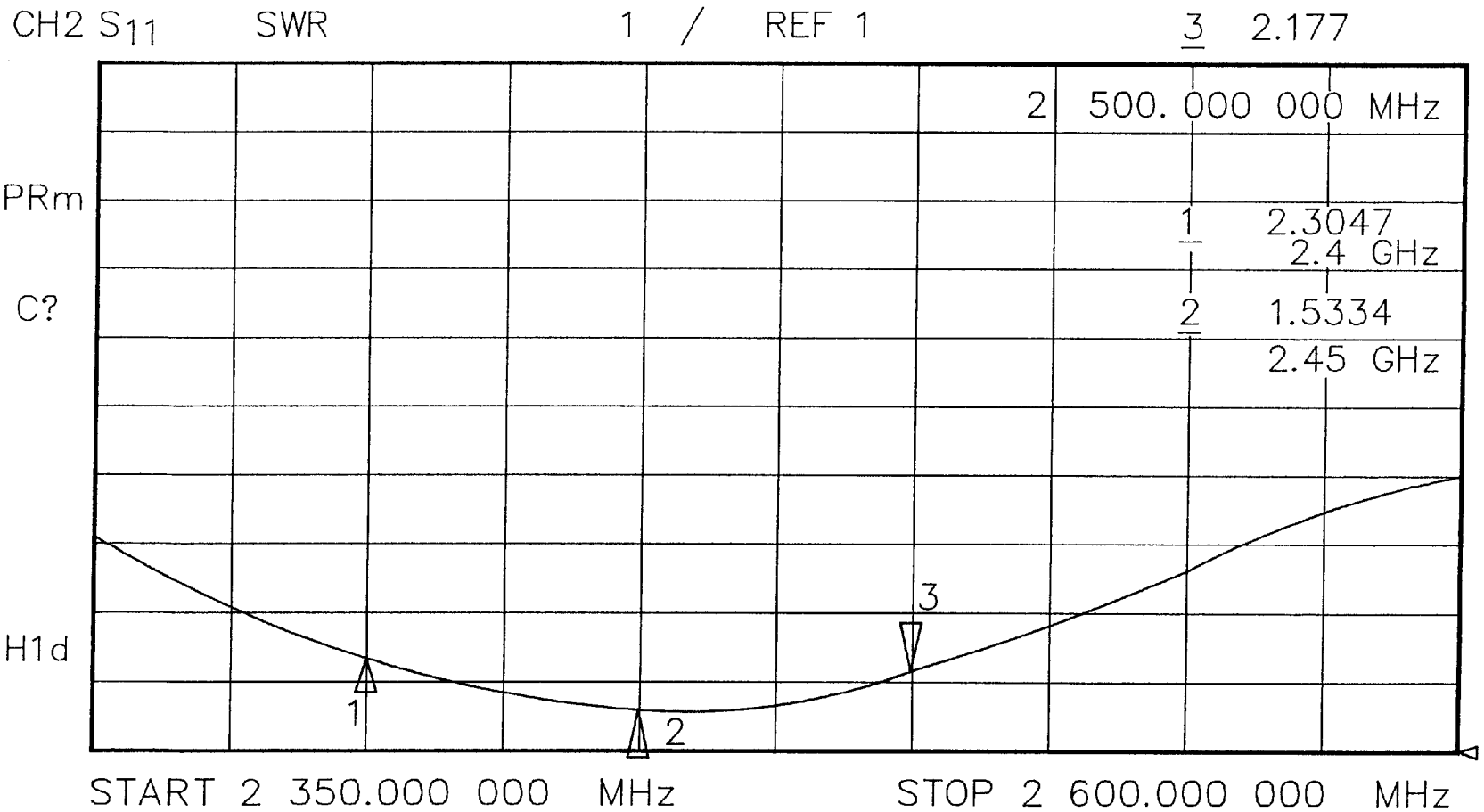
FIG. 6B is a frequency response chart that depicts the characteristics of the VSWR of the second PIFA (Port #2) of the embodiment of FIG. 5.

The results of the tests conducted on the compact diversity antenna 30 consisting of the two PIFAs depicted in FIGS. 5A–5C are shown in FIG. 6. The VSWR characteristics of the first PIFA (antenna 1 with the radiating element 11 and designated RF input as Port #1) are shown in FIG. 6A. Analogous to the first PIFA (antenna 1 with the radiating element 11 and designated RF input as Port #1), the VSWR characteristics of the second PIFA (antenna 2 with the radiating element 12 and designated RF input as Port #2) are shown in FIG. 6B. As seen from the FIGS. 6A and 6B, good impedance match is evident for both the PIFAs of the diversity antenna 30 explained in the third embodiment of this invention. The size of the common ground plane is 16 mm (wide) and 42 mm (length). The projected semi perimeter of the radiating elements 11 and 12 is 28 mm as compared to the semi perimeter of 30.61 mm of a conventional PIFA radiating element without the capacitive loading feature. The single utmost advantage of the compact diversity antenna 30 covered under the third embodiment of this invention is equivalent emergence of the two PIFAs as a single element and the consequent ease of fabrication. Through the above illustrations, the proposed novel design concept of compact layout for a diversity scheme comprising the two PIFAs devoid of physical partitioning between them has been demonstrated.

Figure 7A:
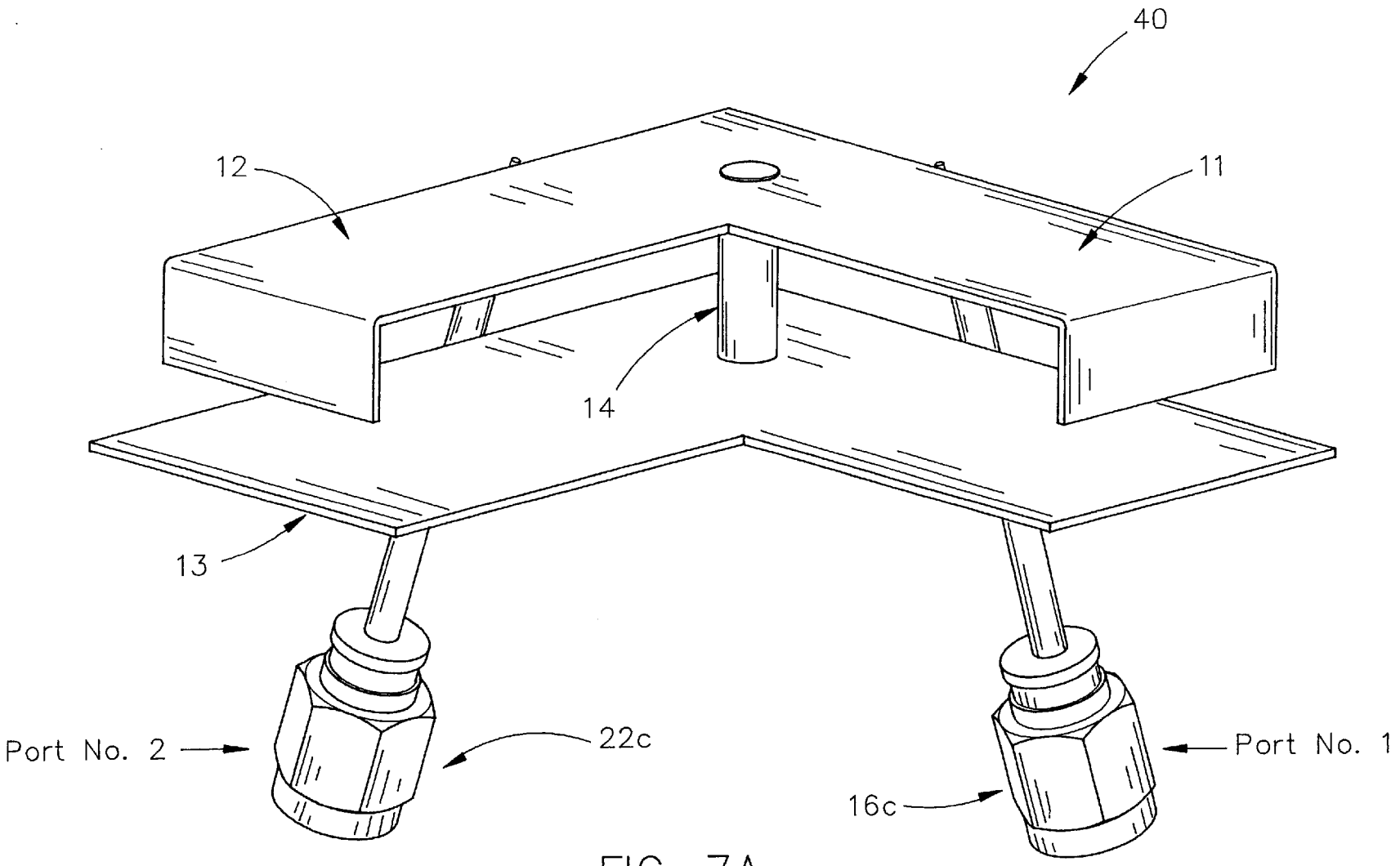
FIG. 7A is an isometric view of the fourth embodiment of the present invention.
Figure 7C:
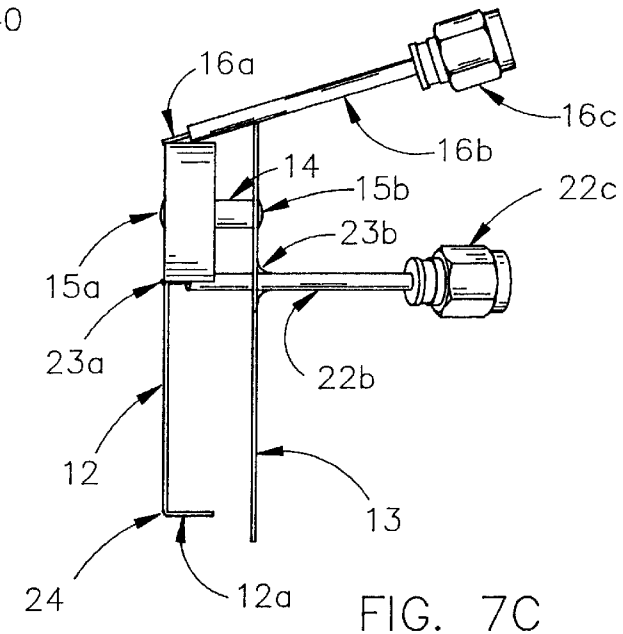
FIG. 7C is an end view of the embodiment of FIG. 7B.
Figure 7B:
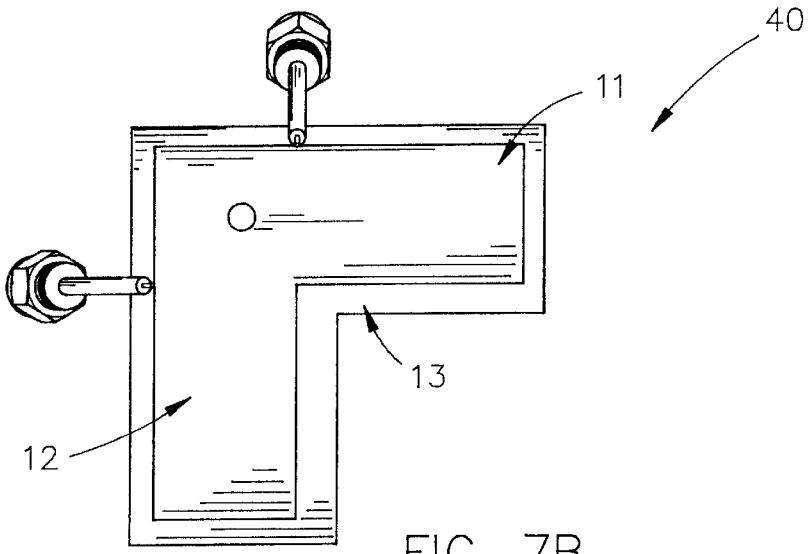
FIG. 7B is a top view of the fourth embodiment of the present invention.
Figure 7D:
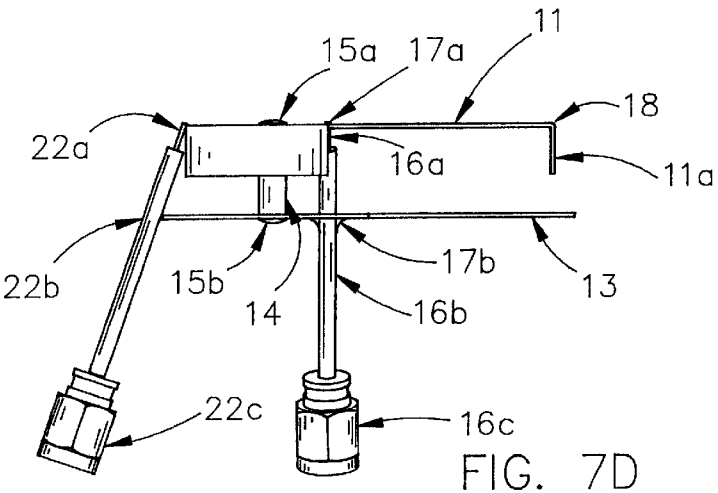
FIG. 7D is another end view of the embodiment of FIG. 7B.

In the first three embodiments of the diversity PIFAs, a common feature is the rectangular shape of the common ground plane. However, in some system applications, the optimal utilization of the available volume for the diversity scheme with internal antennas (PIFAS) may warrant a choice of common ground plane of non-rectangular shapes. With such a design study in view, this invention extends the concept proposed in the third embodiment of this invention to include the case of a common ground of L-shape. The design of compact diversity PIFAs with radiating elements oriented orthogonal to each other and placed on a common ground plane of L-shape forms the thrust of the fourth embodiment of this invention. In the accompanying text describing the compact diversity antenna 40 including PIFAs using a small and common ground plane covered under the fourth embodiment of this invention, refer to the FIGS. 7A–7D for illustrations. As illustrated in the FIGS. 7A–7D, the two PIFAs with the radiating elements 11 and 12 exhibit no physical separation between them. The radiating elements of both the PIFAs are placed over a common ground plane 13 of L-shape. Similar to the diversity antenna 30 of the third embodiment, the two radiating elements 11 and 12 of the PIFAs in the compact diversity antenna 40 of the fourth embodiment of this invention also merge. In the case of diversity antenna 30, the two radiating elements merge along a simple line contour A–A' with the contour A–A' also forming a common boundary to both the radiating elements 11 and 12 (FIG. 5B). In the diversity antenna 40 of fourth embodiment of this invention, the two radiating elements merge along a surface with contour A–A'-B–B' with the surface contour A–A'-B–B' forming a common boundary to both the radiating elements 11 and 12 (FIG. 7B). A shorting post 14 placed at the center of the common boundary serves as a common short circuiting element to both the radiators 11 and 12. As stated previously while explaining the diversity antenna 30, the virtual electrical partitioning between the two radiating elements 11 and 12 is realized through the common shorting post 14. The virtual electrical partitioning between the two radiating elements 11 and 12 in lieu of the proposed choice of placement of the shorting post 14 overcomes the need for physical separation between the two radiating elements to serve as separate antennas of a diversity scheme. All the other elements of the diversity antenna 40 illustrated in the FIGS. 7A–7D are similar to the diversity antennas 10, 20 and 30 of the earlier embodiments which have already been explained. Therefore further redundant detailed explanation of the diversity antenna 40 will not be attempted.

The PIFA configuration with a radiating element 11 explained above and illustrated in FIGS. 7A–7D functions as a single band PIFA. The dimensions of the radiating element 11, the length of the vertical plane 11*a* the location of the shorting post 14, the diameter of the shorting post 14, and the relative position of the radiating element 11 on the common ground plane 13 are the prime parameters that control the resonant frequency of the radiating element 11 of the PIFA. The bandwidth of the single band PIFA with radiating element 11 is determined by: the location of the feed conductor 16*a,* the location of the shorting post 14, the diameter of the shorting post 14 and the linear dimensions of the radiating element 11 including the height of the PIFA. The resonance and the bandwidth characteristics of the first PIFA with the radiating element 11 are also significantly influenced by the second PIFA with the radiating element 12 because of the absence of physical separation between them there by suggesting an increased mutual coupling and reduced isolation between the two ports of a diversity scheme. The orthogonal orientation of the two PIFAs with respect to each other in the diversity antenna 40 helps to achieve relatively better isolation between the two ports as compared to the case of diversity antenna 30. Similar to the case of the third embodiment, the two PIFAs of the diversity antenna 40 has the advantage of being amenable for fabrication as a single element resulting in the cost-effective manufacturing.

Figure 8A:
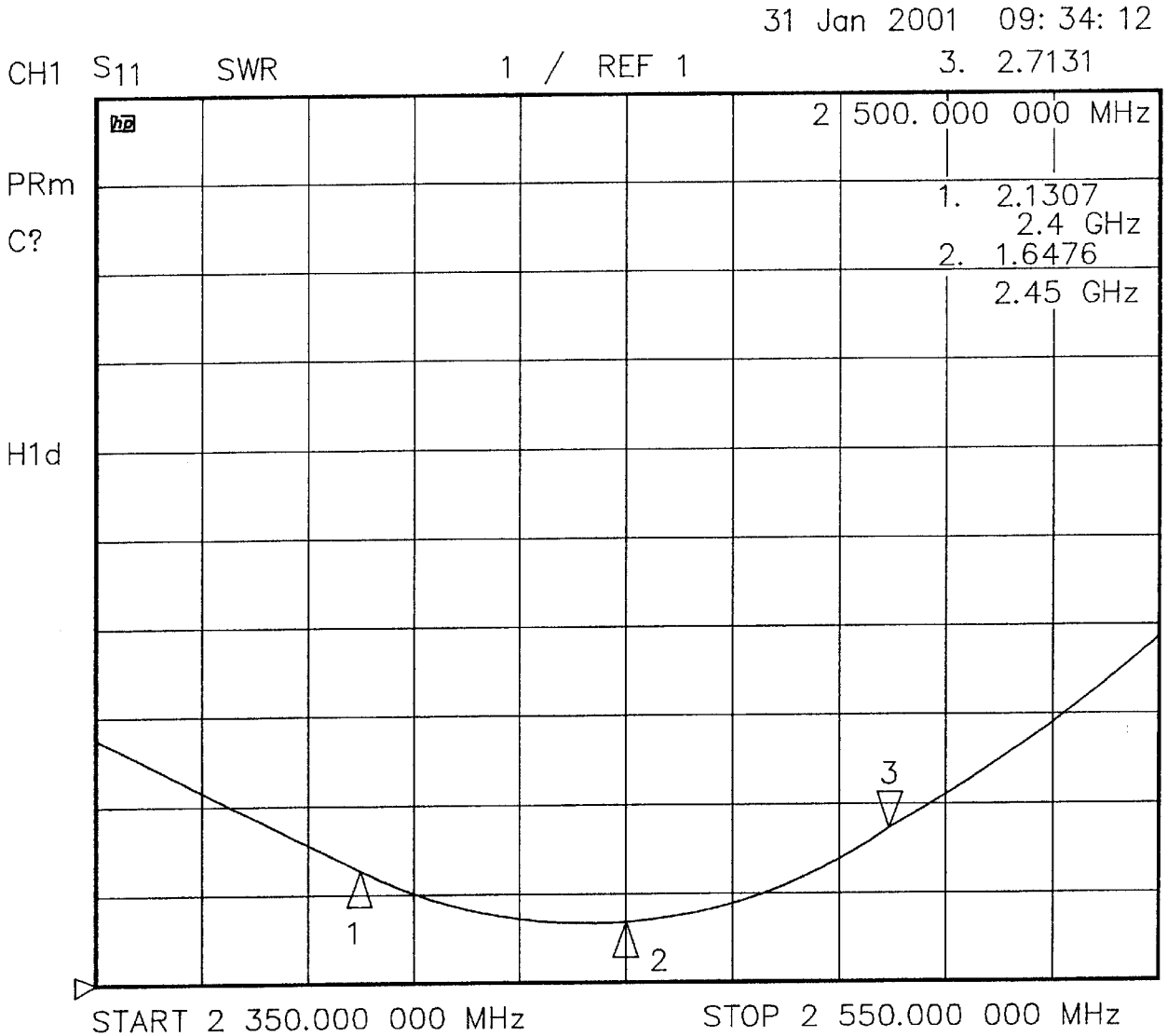
FIG. 8A is a frequency response chart that depicts the characteristics of the VSWR of the first PIFA (Port #1) of the embodiment of FIG. 7.
Figure 8B:
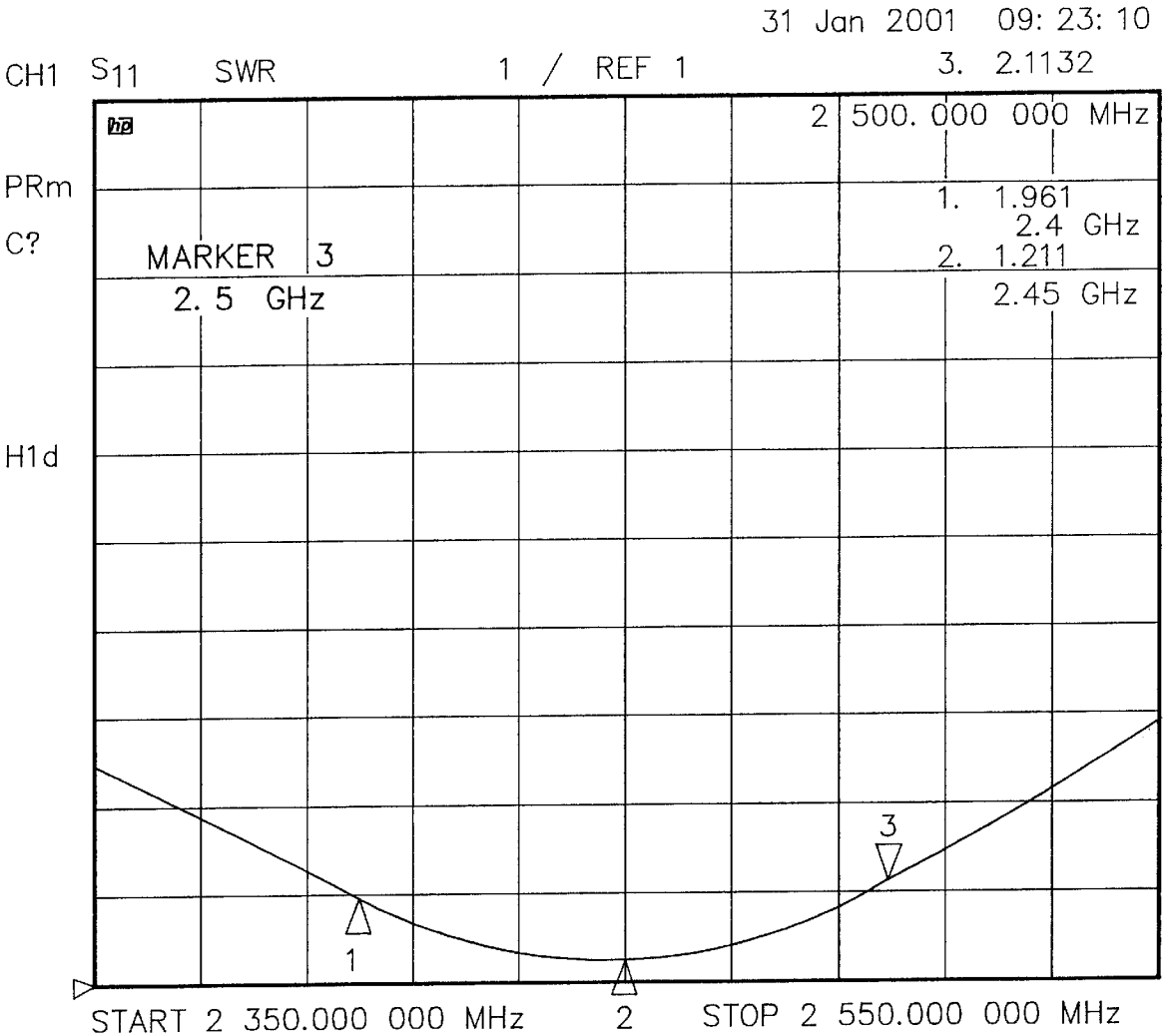
FIG. 8B is a frequency response chart that depicts the characteristics of the VSWR of the second PIFA (Port #2) of the embodiment of FIG. 7.
Figure 9A:
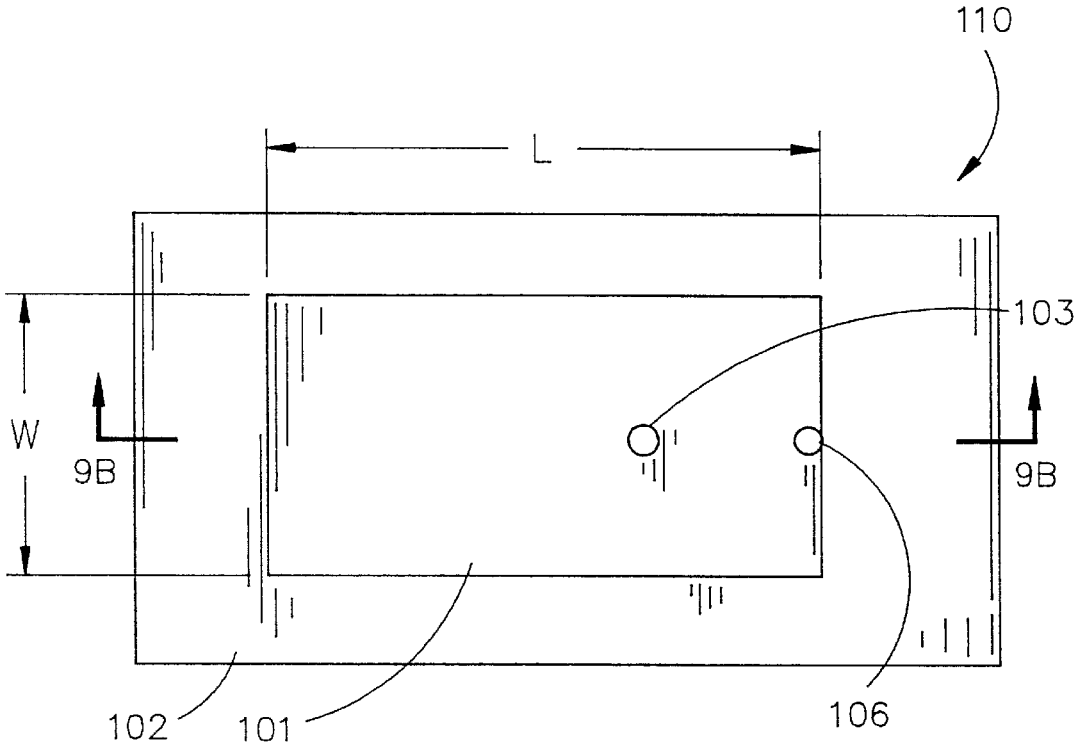
FIG. 9A (PRIOR ART)
FIG. 9A is a top view of a prior art single band PIFA.
Figure 9B:
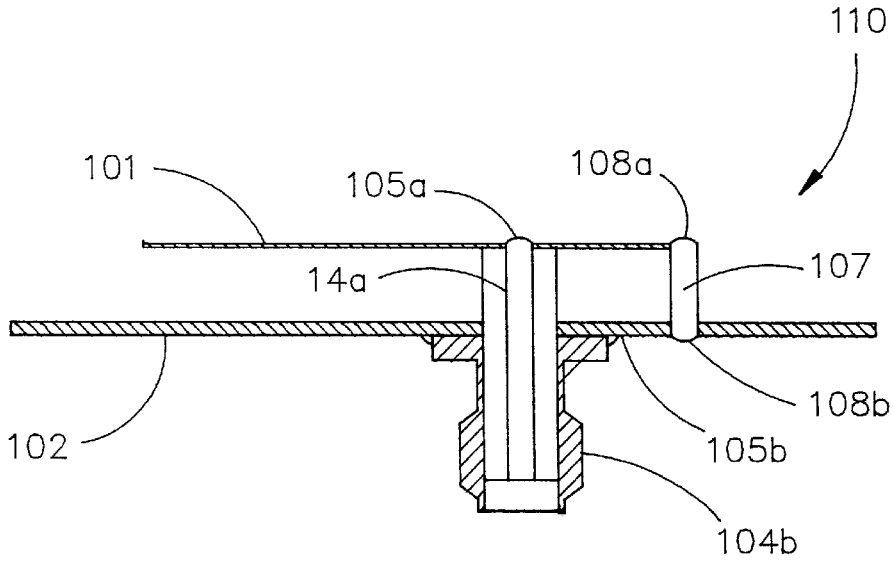
FIG. 9B (PRIOR ART)
FIG. 9B is a sectional view taken along the line B—B of FIG. 9A.

Similar to the PIFA with the radiating element 11 (designated as antenna 1 and RF input Port #1) of FIGS. 7A–7D, the PIFA with the radiating element 12 (designated as antenna 2 and RF input Port #2) also functions as a single band PIFA. The dimensions of the radiating element 12, the length of the vertical plane 12*a,* the location of the shorting post 14, the diameter of the shorting post 14, and the relative position of the radiating element 12 on the common ground plane 13 are the prime parameters that control the resonant frequency of the radiating element 12 of the PIFA. The bandwidth of the single band PIFA with radiating element 12 is determined by: the location of the feed conductor 22*a* on the radiating element 12, the location of the shorting post 14, the diameter of the shorting post 14 and the linear dimensions of the radiating element 12 including the height of the PIFA. Based on the design concept explained under the fourth embodiment of this invention, a compact schematic design for diversity PIFAs with a compact and common ground plane of L-shape has been developed for ISM band (2400–2500 MHz). The two separate PIFAs constituting the two antennas with Port #1 and Port #2 of the diversity antenna 40 according to the fourth embodiment of this invention have been designed and fabricated. The results of the tests conducted on the compact diversity antenna 40 consisting of the two PIFAs depicted in FIGS. 7A–7D are shown in FIG. 8. The VSWR Characteristics of the first PIFA (antenna 1 with the radiating element 11) with RF input designated as Port #1 are shown in FIG. 8A. Analogous to the first PIFA (antenna 1 with the radiating element 11) with RF input as Port #1, the VSWR characteristics of the second PIFA (antenna 2 with the radiating element 12) with RF input designated as Port #2 are shown in FIG. 8B. As depicted in the FIGS. 8A and 8B, good impedance match has been achieved for both the PIFAs of the diversity antenna 40 explained in the fourth embodiment of this invention. The size of the two sections forming the L-shaped common ground plane is 13 mm (wide) and 29 mm (length). The semi-perimeter of the common boundary A–A'–B–B' is 18.5 mm and the projected semi-perimeter of the radiating elements 11 and 12 is 26.75 mm. The novelty of the diversity antenna 40 of the PIFAs is the distinct deviation adopted in the choice of the shape of the ground plane and the resulting orthogonal orientation of the radiating elements. The fore most advantage of the compact diversity antenna 40 covered under the fourth embodiment of this invention is equivalent emergence of the two PIFAs as a single element and the consequent ease of fabrication. Through the above illustrative typical case study, the proposed novel design concept of compact layout for a diversity scheme consisting of the two PIFAs oriented orthogonal to each other and devoid of physical partitioning between them has been demonstrated.

As can be seen from the foregoing discussions, several novel schemes for the design of compact diversity antennas including PIFAs with a small and common ground plane have been developed and demonstrated. To achieve the overall compactness of the lay out of proposed diversity scheme, special emphasis is placed on the utilization of a small ground which is common to both the PIFAs. The concept of capacitive loading has been invoked in this invention to achieve the reduction in the resonant frequency of the PIFAs. The reduction in the resonant frequency is achieved without increasing the physical size of the PIFA. The absence of physical partitioning between the two PIFAs of the proposed schemes realize further compactness of the overall size of the diversity antenna. The diversity antenna 10, the diversity antenna 20, the diversity antenna 30 and the diversity antenna 40 are lightweight, compact and easy to manufacture. In the diversity antenna 30 as well as in the diversity antenna 40, further configuration simplicity is evident because of the absence of physical separation between the PIFAs. In these schemes, the two PIFAs can be fabricated as a single element resulting in the further ease of fabrication. The novel design techniques of the compact diversity antenna consisting of the compact PIFAs of this invention have accomplished all of its stated objectives.

We claim:

1. A diversity antenna comprising two planar inverted F antennas (PIFAs), comprising:

first and second spaced-apart radiating elements; and said first and second radiating elements being positioned over a ground plane which is common to both of said first and second radiating elements;

said ground plane having a length smaller than one-quarter wavelength.

2. The diversity antenna of claim 1 wherein said first and second radiating elements are formed from a single element so that they are of one-piece unitary construction, but are RF spaced-apart by means of a shorting post that extends between said first and second radiating elements and said common ground plane.

3. The diversity antenna of claim 1 wherein said first and second rectangular shaped radiating elements are oriented orthogonally with respect to one another.

4. The diversity antenna of claim 3 wherein said first and second rectangular shaped radiating elements define an L-shape.

5. The diversity antenna of claim 4 wherein said radiating elements are formed from a single element so that they are of one-piece unitary construction, but are RF spaced-apart by means of a shorting post that extends between said first and second radiating elements and said common ground plane.

6. A diversity antenna comprising two planar inverted F antennas (PIFAs), comprising:

first and second spaced-apart radiating elements; and said first and second radiating elements being positioned over a ground plane which is common to both of said first and second radiating elements; said first and second radiating elements having ends which are shorted to said common ground plane; said shorted ends of said first and second radiating elements being positioned back-to-back on said common ground plane to minimize the mutual coupling between said first and second radiating elements.

7. The diversity antenna of claim 6 wherein said common ground plane has opposite ends and wherein said common ground plane is bent downwardly at its opposite ends thereby forming first and second vertical sections.

8. A diversity antenna comprising two planar inverted F antennas (PIFAs), comprising:

first and second spaced-apart radiating elements;

said first and second radiating elements being positioned over a ground plane which is common to both of said first and second radiating elements;

said first and second radiating elements having ends which are shorted to said common ground plane; said shorted ends of said first and second radiating elements being positioned back-to-back on said common ground plane to minimize the mutual coupling between said first and second radiating elements;

said common ground plane having opposite ends and wherein said common ground plane is bent downwardly at its opposite ends, thereby forming first and second vertical sections;

said first and second radiating elements being positioned above said first and second vertical sections, respectively.

9. The diversity antenna of claim 8 wherein said first and second radiating elements are positioned outwardly with respect to said first and second vertical sections of said common ground plane, respectively.

10. A diversity antenna comprising two planar inverted F antennas (PIFAs), comprising:

first and second spaced-apart radiating elements; and said first and second radiating elements being positioned over an L-shaped ground plane which is common to both of said first and second radiating elements; said first and second radiating elements being oriented orthogonally with respect to one another to define an L-shape.

* * * * *